US006581349B1

(12) United States Patent
Riley

(10) Patent No.: US 6,581,349 B1
(45) Date of Patent: Jun. 24, 2003

(54) METHOD AND MANUFACTURE FOR CONSTRUCTING WATERTIGHT

(76) Inventor: Bruce L. Riley, 2410 N. Batavia St., Orange, CA (US) 92865

( * ) Notice: Subject to any disclaimer, the term of this patent is extended or adjusted under 35 U.S.C. 154(b) by 0 days.

(21) Appl. No.: 09/090,849

(22) Filed: Jun. 4, 1998

(51) Int. Cl.[7] ..... E04B 1/02

(52) U.S. Cl. ..... 52/454; 52/342; 52/344; 52/343; 52/596.1; 52/169.7; 4/494

(58) Field of Search ..... 52/596.1, 169.7, 52/342, 343, 344, DIG. 2, 169.6, 315, 444, 454, 741.41; 4/509, 510, 494, 513

(56) References Cited

U.S. PATENT DOCUMENTS

| | | | | | |
|---|---|---|---|---|---|
| 520,137 | A | * | 5/1894 | Deslauriers | 52/343 |
| 782,810 | A | * | 2/1905 | Murphy et al. | 52/454 |
| 1,398,402 | A | * | 11/1921 | Simantz | 52/343 |
| 1,399,222 | A | * | 12/1921 | Magee | 405/25 |
| 1,408,217 | A | * | 2/1922 | Mark | 52/344 |
| 1,776,999 | A | | 9/1930 | Jensen | |
| 1,827,945 | A | * | 10/1931 | Land | 52/454 |
| 1,841,905 | A | * | 1/1932 | Meiswinkel | 52/344 |
| 1,872,984 | A | * | 8/1932 | Land | 52/454 X |
| 1,892,433 | A | * | 12/1932 | Huff | 52/454 X |
| 2,045,482 | A | * | 6/1936 | Maier | 52/454 X |
| 2,208,191 | A | * | 7/1940 | Kerr | 52/343 |
| 2,321,813 | A | * | 6/1943 | Henzel | 52/454 |
| 2,324,131 | A | * | 7/1943 | Boylan | 52/454 X |
| 2,669,114 | A | * | 2/1954 | Mills | 52/454 |
| 3,114,153 | A | * | 12/1963 | Pierson | 4/172 |
| 3,123,025 | A | * | 3/1964 | Fugelstad | 52/444 |
| 3,402,522 | A | * | 9/1968 | Guddal | 52/344 |
| 3,441,457 | A | | 4/1969 | Regnaud | |
| 3,844,527 | A | | 10/1974 | Scott | |
| 3,950,477 | A | * | 4/1976 | Giacomo | 264/226 |
| 4,051,562 | A | * | 10/1977 | Jakowicki | 4/172 |
| 4,070,849 | A | | 1/1978 | DiGiacomo | |
| 4,094,110 | A | * | 6/1978 | Dickens et al. | 52/80 |
| 4,149,351 | A | | 4/1979 | Belt | |
| 4,253,288 | A | * | 3/1981 | Chun | 52/454 |
| 4,352,260 | A | * | 10/1982 | Pearcey et al. | 52/80 |
| 4,605,529 | A | | 8/1986 | Zimmerman | |
| 4,751,803 | A | | 6/1988 | Zimmerman | |
| 4,873,802 | A | | 10/1989 | Dahowski | |
| 4,875,322 | A | * | 10/1989 | Rozzi | 52/746 |
| 4,970,838 | A | * | 11/1990 | Phillips | 52/250 |
| 5,108,671 | A | | 4/1992 | Chapdelaine | |
| 5,215,406 | A | * | 6/1993 | Hudson | 405/25 |
| 5,249,744 | A | | 10/1993 | Ruthenberg | |
| 5,417,016 | A | | 5/1995 | Dahowski | |
| 5,491,948 | A | * | 2/1996 | Harris | 52/596 |
| 5,598,673 | A | * | 2/1997 | Atkins | 52/302.1 |
| 5,681,636 | A | * | 10/1997 | Minagawa et al. | 428/143 |
| 5,685,119 | A | * | 11/1997 | Bradshaw et al. | 52/311.1 |
| 5,809,725 | A | * | 9/1998 | Cretti | 52/426 |

OTHER PUBLICATIONS

Print of Inter–Fab website page, circa Jun. 1998 URL=http://www.inter–fab.com/.

* cited by examiner

*Primary Examiner*—Lanna Mai
*Assistant Examiner*—Phi Dieu Tran A
(74) *Attorney, Agent, or Firm*—Philip H. Haymond

(57) ABSTRACT

A method and article of manufacture for building waterproof concrete structures. An integral casing comprised of a rigid plastic shell with an armature attached to its face is covered with concrete. The shell is formed either in the shape of a desired structure or in a generic shape to be used to splice together a larger custom structural shape in a mosaic fashion. The shell acts both as a form to support the wet poured concrete and becomes an integral part of the finished structure to provide waterproofing.

5 Claims, 5 Drawing Sheets

METHOD AND MANUFACTURE FOR CONSTRUCTING WATERTIGHT

A portion of the disclosure of this patent document contains material which is subject to copyright protection. The copyright or trademark owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to the field of water-tight concrete wall and structure construction. This invention relates more particularly to an improved method and manufacture for constructing waterfalls, cliffs, slides and the like around a swimming pool to give the pool the naturalistic look and atmosphere of a naturally formed wilderness pond.

BACKGROUND OF THE INVENTION

Most concrete structures such as buildings, outdoor barbeques, shower stalls and swimming pools are constructed by first assembling forms to hold the concrete in place. Armature, usually in the form of a matrix of steel rebar is then placed in the form to give the concrete added tensile strength, different sections of armature may need to be spliced together with steel wire. Concrete is then poured over the armature, immersing the armature. An waterproofing layer is included by either mixing a waterproofing compound with the concrete or applying it directly on the concrete after it has hardened. A second, textured finishing layer of concrete may then be placed atop the first layer of concrete over the waterproofing. After the concrete has hardened the forms are removed.

"Cementatious material" as used herein means concrete, mortar or the like.

A solid concrete wall is built in a similar fashion but sheet forms such as plywood must typically be used to hold the concrete in place while it dries and hardens.

An alternative to solid concrete construction, where the strength of solid rebar armature-reinforced concrete is not required, is wood and mortar or stucco construction. For example, a stucco wall is usually built by constructing a wood frame, covering the wood frame with a waterproof membrane such as tar paper, covering the tar paper with a mesh and troweling or spraying on one or more layers of mortar or concrete over the mesh. The wall is structurally supported by the wood frame and the concrete layer is added to provide the strength and imperviousness of masonry.

A multitude of structures can be built from concrete and many of them require special forms and skill to assemble them correctly. One or a combination of the above methods are used to construct these structures.

A mortar shower stall for example is first built from wood, then a waterproof membrane is affixed to floor and walls. The walls of the shower stall are covered with an armature of steel mesh and heavier rebar is used for the armature placed on the floor. A continuous layer of mortar is then placed on the mesh and over the floor armature to build the walls and floor. Great skill is required to ensure the walls are flat and the floor slopes towards the drain. A final layer of tile may be added to the walls and floor to finish the shower stall.

Other examples of specialized concrete construction abound: window wells placed outside of basement windows; reinforced concrete bunkers, sometimes referred to as pillboxes used for military applications; outdoor barbeques; outdoor sinks and fireplaces, all must be both waterproof and of a certain shape.

The construction of naturalistic artificial rock structures surrounding a swimming pool requires a particularly specialized construction. The vast majority of swimming pools are constructed with a surrounding plain, flat concrete or wooden deck. These decks are functional but uninteresting and do not take advantage of the inherent aesthetic rewards that can be added to a body of water. There has been a trend in swimming pool design to incorporate naturalistic elements into the surrounding deck, such as waterfalls and rocks, such that the pool looks like a natural mountain pond or tropical grotto.

The most common swimming pool waterfall construction technique requires that concrete footings, reinforced with steel rebar, first be anchored in the ground. Thereafter, an armature or steel skeleton in the general shape of the finished fountain or other naturalistic artificial rock structure is anchored to the footings. The armature is laboriously formed by bending the steel rebar into the basic shape of the desired finished structures. When the armature is shaped to form a resulting enclosed structure, having a hollow interior, framework such as wood bracing and steel-reinforced concrete support columns must frequently be used in the internal area to reinforce the artificial rock structure and ensure structural integrity.

Castings are pre-cast impressions made from the image of natural rock. These castings are sheet-like and usually made from concrete or fiber-embedded concrete. The castings are made using a latex mold which was in turn made from an impression of natural rock.

After the armature is completed, a mesh of steel, burlap or nylon netting is placed over the armature and tied to it. This mesh provides a surface to hold the concrete in place. A first structural layer of concrete is poured over the mesh and allowed to harden. An elastomeric waterproof coating is then applied to the structural concrete coat. Castings and natural rock are optionally then embedded to the structural coat over the waterproof lining and a second, textured coat of concrete is applied. The castings are filled with concrete to affix them to the structure. A final, textured concrete coat is applied to the structural coat and textured and colored to give the appearance of natural rock.

There are other methods for building naturalistic waterfalls and other artificial rock structures but they too have drawbacks. Natural rock itself can simply be cemented together to make the structures, but natural rock is heavy and difficult to move; it is expensive to buy and to transport, it is difficult to work with; it also requires a high degree of skill to ensure that a structurally sound artificial rock structure is built, and, natural rock tends to be difficult to water seal, it tends to leak water when used alone to build a waterfall or basin.

Another method to constructing these artificial rock structures is to use preformed plastic or urethane rocks and waterfalls and simply attach them around the pool. These structures tend to be unconvincing and fake in appearance though. Moreover they are also flimsy and structurally weak and tend to fade and crack under the stress of sun and people climbing on them. These fake rocks are just for decoration, being made out of plastic or urethane, they do not incorporate steel-reinforced concrete.

The current methods and technology for naturalistic artificial rock structures require a high degree of skill and expense to install and they frequently leak and crack unless the installation is meticulously executed.

Various efforts have been made in the past to create naturalistic artificial rock structures. Jensen, U.S. Pat. No. 1,776,999 teaches forming a mold made from crinkled paper, preferably supported by framework and having a paraffin lining, to simulate the natural irregularity of rock. The form is filled with a plastic material, resulting in either a hollow, structurally weak artificial rock or a solid heavy ball of concrete.

DiGiacomo, U.S. Pat. No. 4,070,849 describes a method for making a swimming pool wall out of a mold made on natural rock. The natural rock is covered with latex, then a urethane foam. The form made of foam is removed as used as the form for the wall in building the swimming pool. This allows the use of a naturalistic finish for a pool wall but cannot be used for a freestanding structure. Moreover it requires the same high level of skill to build as the current methods do.

The Interfab company of 3831 E. Technical Drive, Tuscon, Ariz. makes prefabricated hollow concrete and fiberglass artificial rock structures such as water falls for use around a swimming pool. The user places these fake hollow rocks then either fills them with concrete or simply affixes the hollow structure to the pool deck. These structures have several drawbacks, they are decorative and unless they are filled with concrete they are too weak to be climbed on. If they are filled with concrete they can become so heavy as to stress the underlying deck, or to settle and shift. Each of the limited number of models is mass produced as identical units too, limiting the possibility of having a custom look to the finished artificial rock structure.

Chapdelaine, U.S. Pat. No. 5,108,671, teaches a set of precast forms wherein they are joined to make a form for a pre-designed overall shape, concrete is then poured into the forms and the forms are then removed.

The foregoing current multi-stage methods of constructing concrete and concrete-covered structures are well known in the art. They require a high degree of skill to shape the finished product, to place the forms correctly and particularly to ensure the integrity of the waterproofing of the concrete. The present methods are also wasteful in that the forms must be discarded or stored after use, and a given shape must be repeatedly reconstructed from forms when a similar construction is subsequently undertaken. The present methods are also time-consuming, requiring the forms to be set, the armature and mesh to be placed and, after the concrete is poured, the removal of the forms. Finally, the above methods are difficult to design by engineers and difficult to inspect by building inspectors, because they are frequently custom jobs.

None of the prior art discloses the major efficiencies that are realized by the current invention, which allows both flexibility, waterproofing and structural soundness. Moreover the invention allows building inspectors and engineers to design and inspect a predictable structure, because it is difficult to review the structural integrity of a seemingly custom job.

Accordingly, it is a primary object of the present invention to provide an improved and inexpensive method and article of manufacture to construct a waterproof concrete structure.

Another object of the invention is the provide a system of building standardized waterproof concrete structures in an easy, consistent manner, requiring a lower degree of skill while maintaining sophisticated craftsmanship in the finished structure.

Another object of this invention is to provide a system of building customized waterproof concrete structures in an easy, consistent manner, requiring a less labor and expense.

Another object of this invention is to provide a more predictable and consistent construction of custom waterproof concrete structures to allow easier design, structural predictability and inspection by building inspectors.

It is yet another object of the invention to provide a manufacture that requires only a single application of concrete instead of both a structural coat and then a texture coat.

These and other more specific objects will be apparent upon reading the following specification and claims and upon considering in connection therewith the attached drawings to which they relate.

SUMMARY OF THE INVENTION

The present invention is a method and article of manufacture for building waterproof concrete structures. An integral casing comprised of a plastic shell with an armature attached to its face is covered with concrete. The shell is formed either in the shape of a desired structure or in a generic shape to be used to splice together a larger custom structural shape in a mosaic fashion. The shell acts both as a form to support the wet poured concrete and becomes an integral part of the finished structure to provide waterproofing. Only a single coat of concrete is required with this manufacture and method because there is no need to apply an intervening waterproofing layer.

DETAILED DESCRIPTION OF THE DRAWINGS AND THE INVENTION

Figure 1:
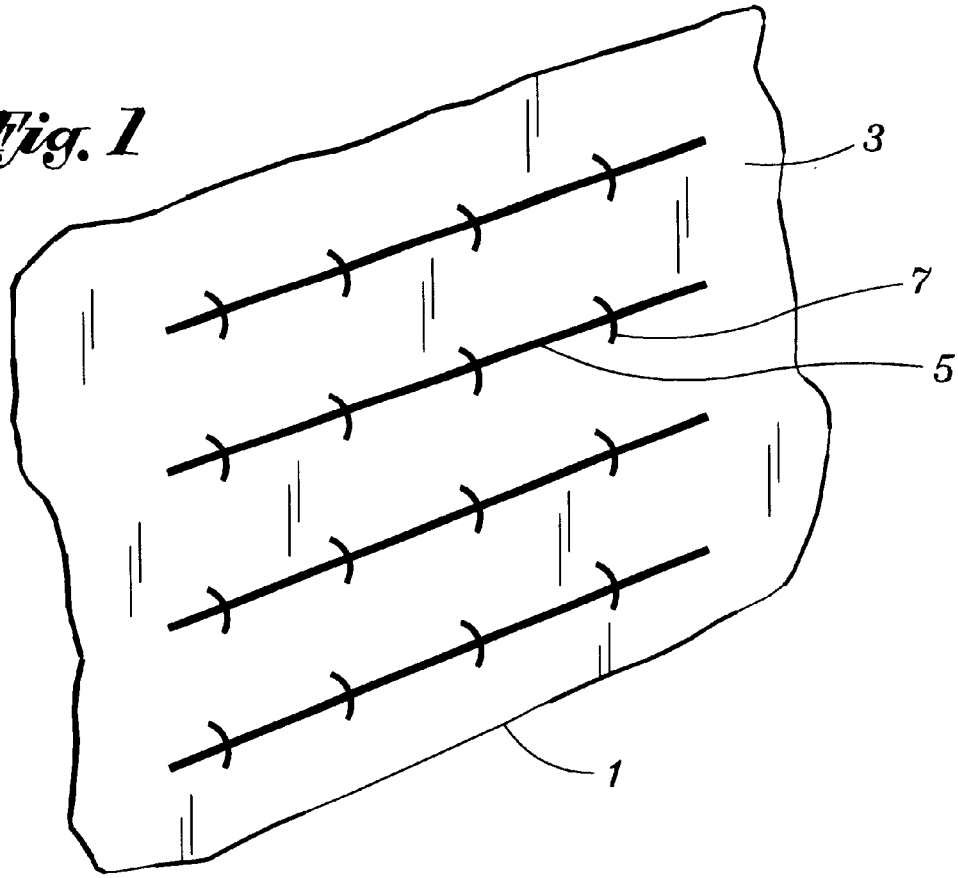
FIG. 1 is a perspective view of a integral casing.

Referring now to FIG. 1, there is shown a prefabricated integral casing 1 of a generic shape comprised of a shell 3, and an armature 5, that is attached to the shell with fasteners 7.

In the preferred embodiment clips are used to fasten the armature to the shell and these clips are made of plastic. Any fastener or fastening method can be used though that will attach the armature to the shell until poured concrete can harden and bond with the shell and armature. The shell itself could be formed to receive the armature and in effect also serve as a fastener. In all cases though the armature should be held at least an inch from the shell for the concrete to flow behind it.

The armature is comprised of a matrix of steel rebar and, optionally a mesh attached over the steel rebar (not shown) to hold in the concrete while it dries. The mesh can optionally be added to the armature during fabrication, later attached to the face of the rebar, or, alternatively a fabric mesh or netting can be placed over the rebar at the job site prior to pouring the concrete.

The shell can be formed from fiberglass, polyvinylchloride, ABS, or any material that will provide a waterproof barrier for concrete, these materials are well known in the art. The shell can be flexible but in all cases it should be rigid enough to support the surcharge of weight of the armature and the surcharge of weight of the concrete when it is poured. On occasion, the shell may need some minor ancillary formwork to support it during the cement curing process.

The types of rebar and types of cement or mortar to be used for a given application are well known in the art. The rebar could be made of steel but it can be made from other materials and this too is well known in the art. The shell and armature are sized to accommodate a given application, with a heavier, thicker shell and a heavier, thicker rebar being used when a thicker or more load-bearing application is desired. In all cases care should be given to form the exterior face of the concrete to allow any water thereon to drain adequately.

Figure 2:
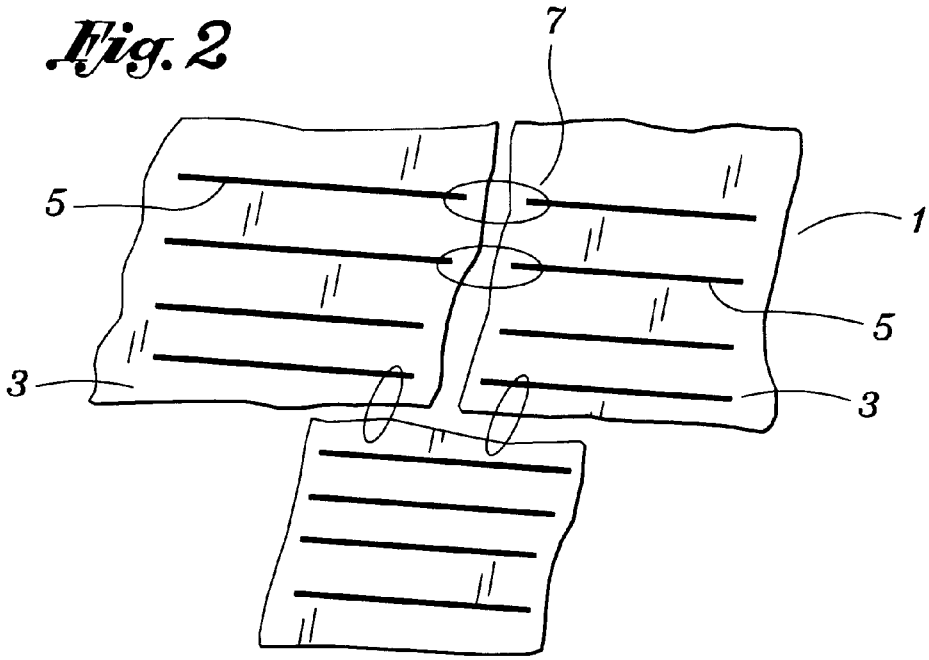
FIG. 2 is a front view of a plurality of integral casings spliced together to create a custom design.

Referring now to FIG. 2 there is shown a plurality of integral casings 1 spliced together in a mosaic fashion to form a custom shape. Adjacent integral casings are placed with the shells 3 slightly overlapping to ensure a continuous waterproof barrier. Armature 5 is spliced together with a length of steel rebar 7, tied or looped to adjoining armatures to form in effect a continuous armature, making up the object of the builder's design. In this embodiment the composite mosaic is then covered with mesh and then concrete is poured, troweled or sprayed over the entire structure. Armature of adjoining integral casings should best be spliced together by tying them together with a thirty-six inch span of steel rebar, overlapping each armature by at least eighteen inches. Any number of integral casings may be spliced together to form a completed structure of custom design.

Figure 3:
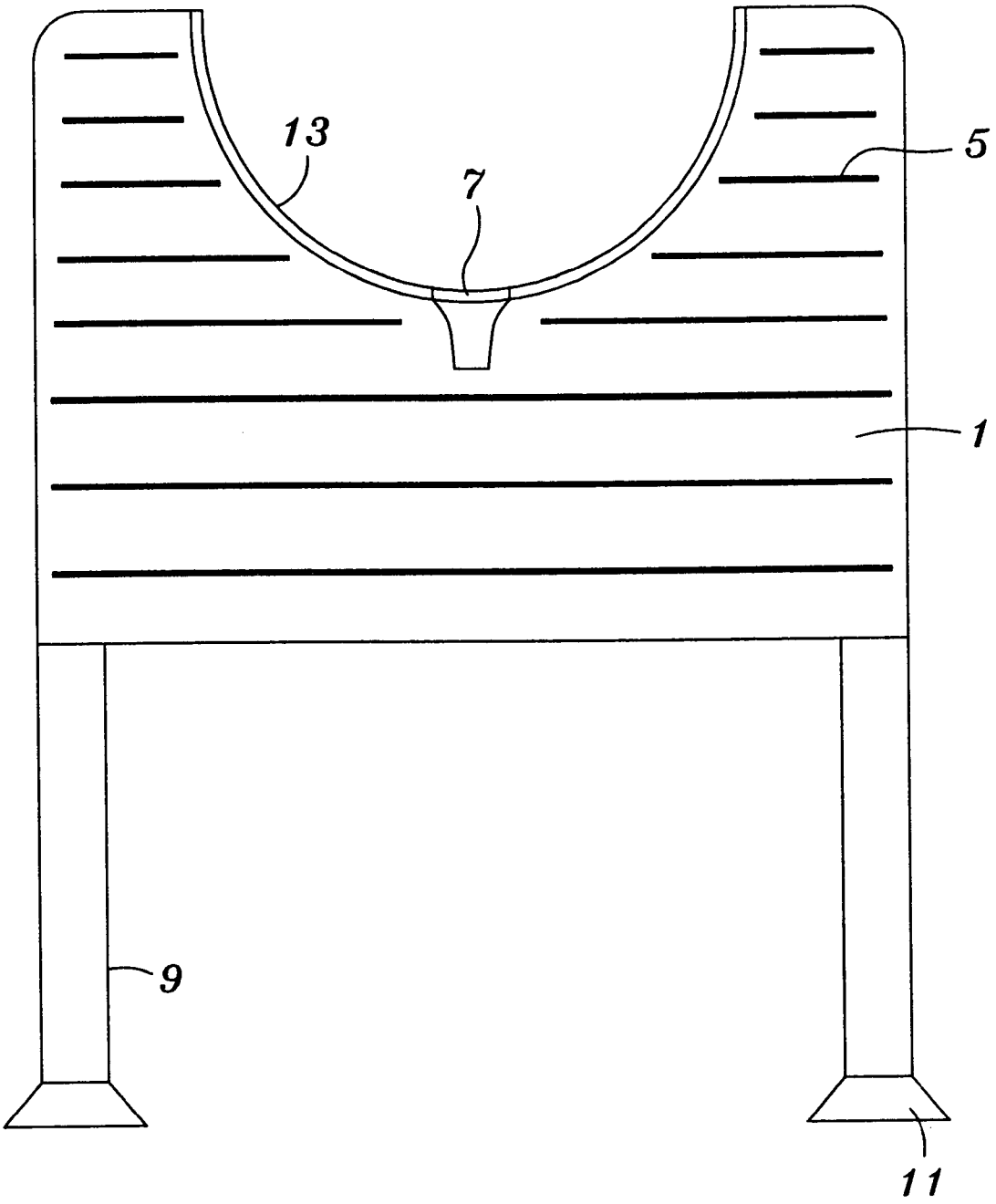
FIG. 3 is a cross sectional view of an integral casing shaped as a concrete sink.

FIG. 3 is an example of an integral casing being prefabricated in the shape of a functional structure, in this case and outdoor basin or sink. The integral casing 1 is shaped as a concrete basin having an exterior skirt 3. For this embodiment armature 5 is made of a steel half-inch mesh only, there being no need for the heavier structural rebar. There is further a prefabricated drain hole 7 formed to receive a drain in the center of the integral casing. The shell is further integrally formed with legs 9 to support the sink, but the sink could optionally be formed without legs and a wooden stand constructed to hold the basin instead. The legs of the sink are first anchored to footings 11. The drain hole 7 is then plumbed and concrete is poured or troweled on the entire armature. In this case care must be taken when pouring and finishing the concrete to ensure that the floor of the basin 13 is sloped towards the drain opening to allow water placed therein to drain properly. The floor and sides of the basin itself are best finished with concrete with a smooth finish, while the skirt can be finished in any aesthetically pleasing manner.

Figure 4:
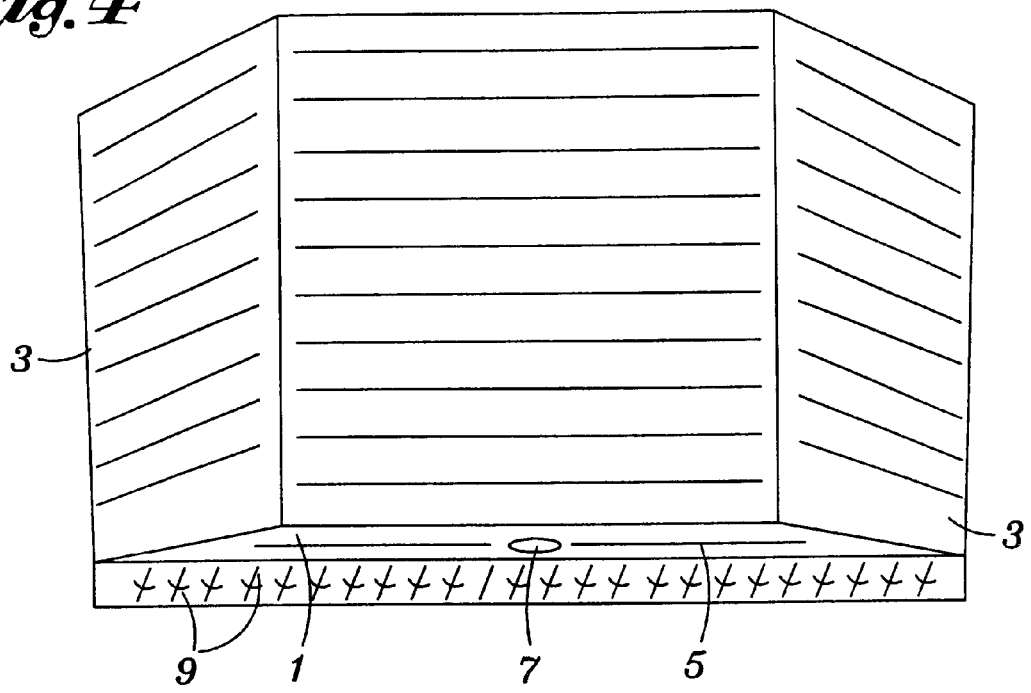
FIG. 4 is a front view of an integral casing shaped as a mortar shower.

FIG. 4 is a second example of an integral casing being prefabricated in the shape of a functional structure, in this case a mortar shower stall. Mortar showers have several qualities that make them much more desirable than other constructions. Mortar showers have a desirable solid feel to them, tile can be placed on them and they are one of the longest-lasting types of shower stalls with an expected life of fifty years or more.

In the past mortar showers have been notoriously expensive and difficult to install because they require a high degree of skill to execute. A form is first built from wood then a waterproof membrane is affixed to floor and walls. The walls are covered with an armature of steel mesh and heavier rebar is used for the armature placed on the floor. A continuous layer of mortar is then placed on the mesh and over the floor armature to build the walls and floor. Great skill is required to ensure the walls are flat, vertical and that the floor slopes towards the drain. A final layer of tile is usually added to the walls and floor to finish the shower stall.

Because of the great difficulty and resulting expense of building a mortar shower stall, the trend has been to instead use inferior prefabricated shower stalls made of fiberglass, plastic or stamped steel. None of these products has the quality and feel of the more solid mortar shower stall, nor can most of them be tiled with ceramic tile. These other pre-fabrications also have a significantly shorter life than a mortar shower stall, being designed to last only five to twenty years.

The integral casing 1 here is shaped as a shower stall having upwardly extending walls 3 and basin 5. For this embodiment armature 7 is made of a steel half-inch mesh for the walls and with a heavier three-eights inch rebar 9 for the basin portion of the shower stall. There is further a prefabricated drain hole 11 in the basin formed to receive a drain in the center of the integral casing. The shower stall is placed and then the drain hole 9 is plumbed. Mortar is poured or troweled on the entire armature and in this case care must be taken when pouring and finishing the concrete to ensure that the basin is sloped towards the drain opening to allow water placed therein to drain properly. Care must also be taken to ensure that the walls are flat and vertical. Ceramic tile may then be affixed to the mortar.

Figure 5:
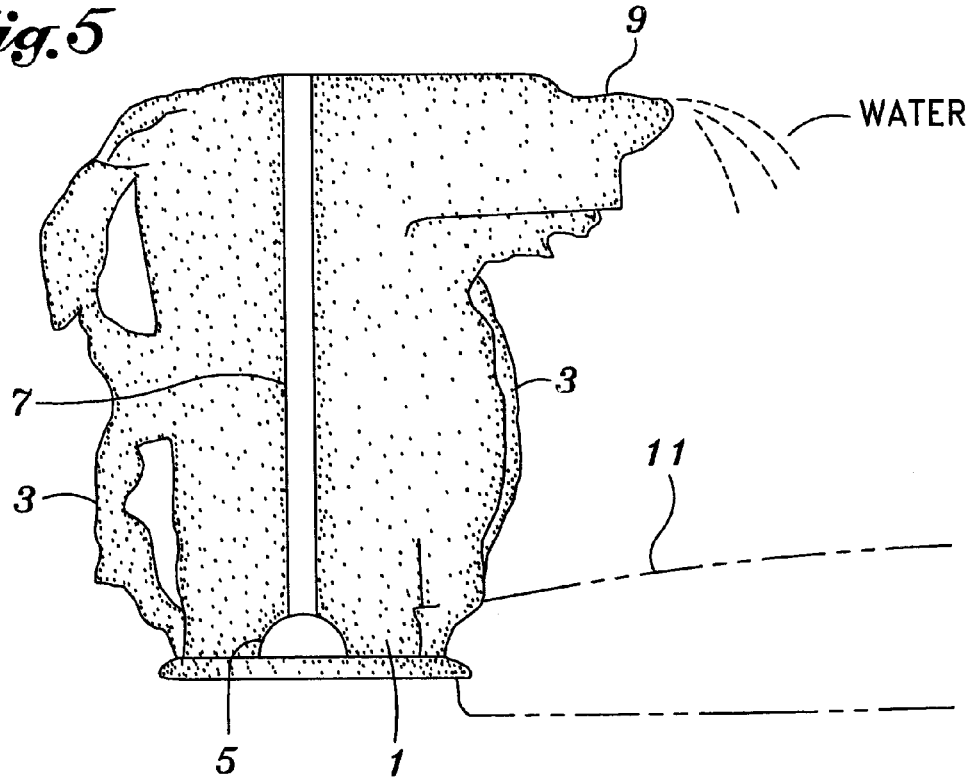
FIG. 5 is a cross sectional view of an integral casing shaped as a artificial rock structure.

Referring now to FIG. 5, a cross-sectional view of an integral casing 1 shaped as an artificial rock structure for placement next to a swimming pool, shown as 11. In this embodiment the integral casing is in the general shape of a artificial rock structure to be used as a waterfall, the armature 3 to be later covered with concrete. A pump 5 is shown, which pumps water through return pipe 7 to cascade down the flat tray side of the rock structure, shown at 9.

Figure 6:
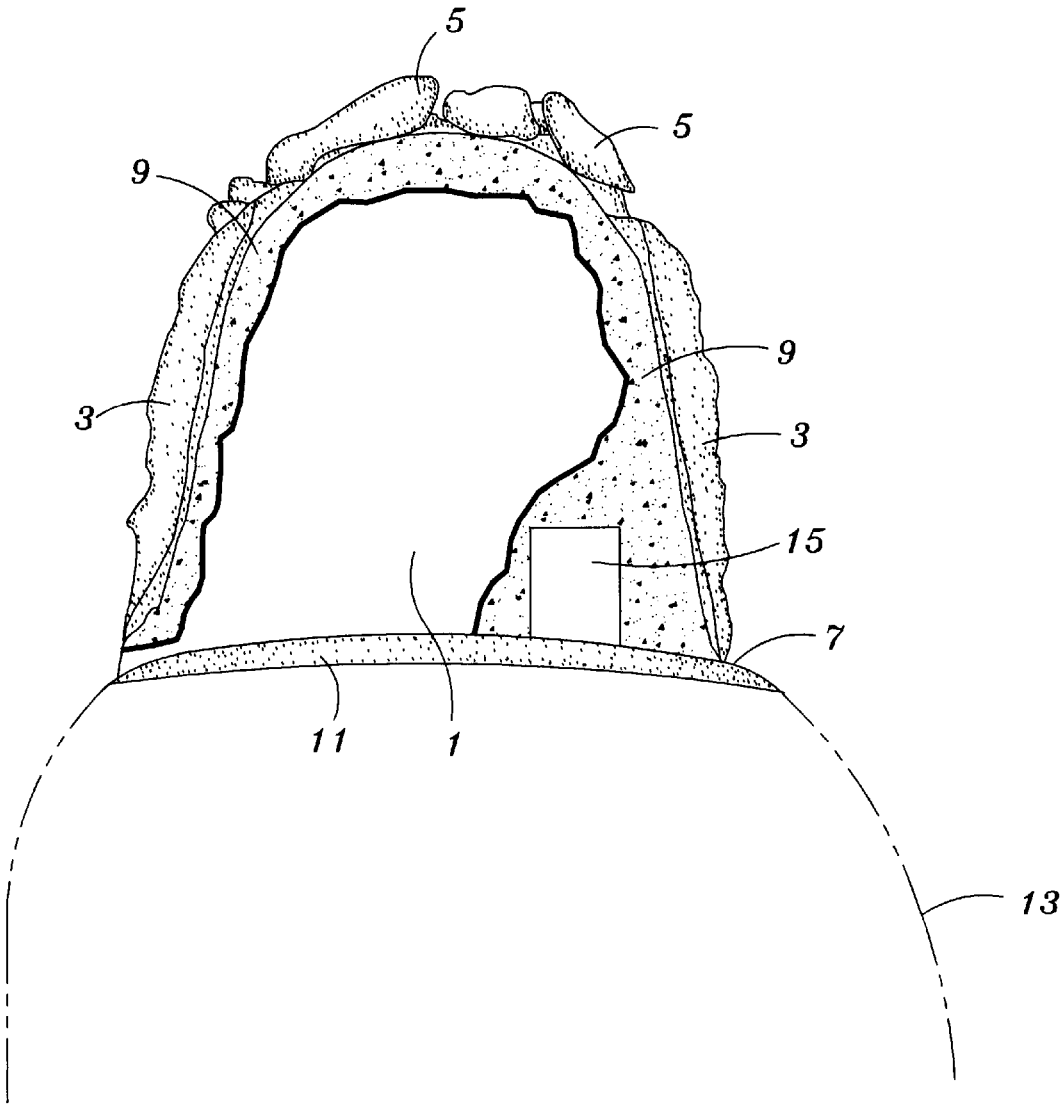
FIG. 6 is a side cross-sectional view of an integral casing shaped as an artificial rock structure, cover with concrete and having castings attached to it.

FIG. 6 is a side cross-sectional view of an integral casing shaped as an artificial rock structure, covered with concrete and having castings attached to it.

Figure 7:
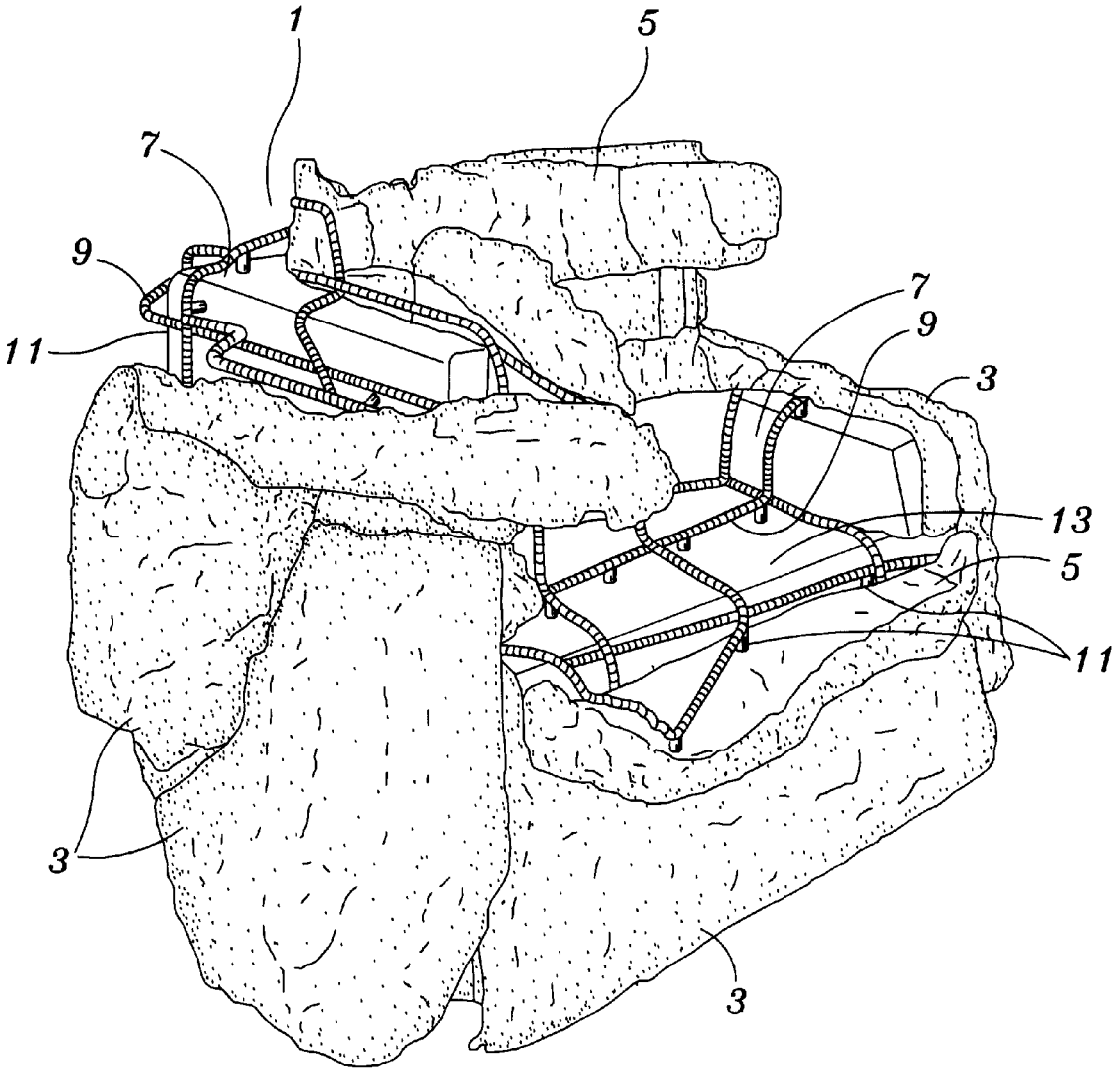
FIG. 7 is a partial cutaway perspective view of an integral casing shaped as an artificial rock structure.

FIG. 7 is a perspective view of an integral casing as used during construction shaped as an artificial rock structure, having castings attached to it and prepared to receive a cementatious coating.

The integral casing 1 may be further formed to fit the lip 11 of a conventional swimming pool, shown as 13. In this way the finished artificial rock structure will divert water cascading off it into the swimming pool, as well as to have a custom look even when retrofitted to an existing swimming pool. A door 15 is shown here, allowing access to the interior of the finished artificial rock structure for use as a storage room.

FIG. 7 is a perspective view of an integral casing 1 shown as used during construction of an artificial rock structure, here a waterfall of the type shown in FIG. 5.

The integral casing 1 can be seen partially exposed in this figure. The integral casing 1 has castings 3 and natural rock 5 attached to the armature 9 of the integral casing and it is prepared to receive a cementations coating. The shell 7 of the integral casing 1 is in the general shape of an artificial rock structure to be used as a waterfall; the armature 9, is attached to the shell with fasteners 11, and the shell and armature will be later covered with cemetatious material. A pump (shown as 5 in FIG. 5) supplies water to cascade down the flat tray side of the rock structure, shown generally at 13.

The description of the embodiments of the article of manufacture and method claimed herein should not be construed as limiting, and additional applications of this apparatus and method will be plain to one of ordinary skill in the art.

What is claimed is:

1. A three-dimensional waterproof concrete structure used in an environment in which the structure will be exposed to water, comprising:

a free-standing, integral casing comprising:

a three-dimensional, free-standing, waterproof shell having an exterior surface, that is sufficiently rigid to support a layer of concrete material;

a plurality of fasteners directly attached to the shell; and a matrix of structural reinforcement material having a side facing the exterior surface of the shell, the side being attached by the fasteners to and spaced from the exterior surface to define a three-dimensional gap therebetween, the matrix conforming to and covering at least a substantial portion of the exterior surface; and a hardened cementatious material covering the integral casing, the cementations material being initially flowable so as to envelop the matrix and enter the gap, thus bonding the matrix to the shell when hardened, wherein the free-standing shell is substantially hollow so as to form an interior area and a door way is provided in one side of the shell to enable access into the hollow interior of the shell.

2. A three-dimensional waterproof concrete structure used in an environment in which the structure will be exposed to water, comprising:

a free-standing, integral casing comprising:

a three-dimensional, free-standing, waterproof shell having an exterior surface, that is sufficiently rigid to support a layer of concrete material;

a plurality of fasteners directly attached to the shell; and a matrix of structural reinforcement material having a side facing the exterior surface of the shell, the side being attached by the fasteners to and spaced from the exterior surface to define a three-dimensional gap therebetween, the matrix conforming to and covering at least a substantial portion of the exterior surface; and a hardened cementations material covering the integral casing, the cementations material being initially flowable so as to envelop the matrix and enter the gap, thus bonding the matrix to the shell when hardened, wherein the free-standing shell is substantially hollow so as to form an interior area wherein the structure is formed in the shape of an artificial rock structure and is provided with a pump and plumbing to create a waterfall over the exterior of the structure.

3. A method of making a three-dimensional waterproof concrete structure used in an environment in which the structure will be exposed to water, comprising the steps of:

providing a three-dimensional, free-standing, waterproof shell that is sufficiently rigid to support a layer of concrete material, having an exterior surface;

providing a plurality of fasteners and attaching the fasteners to the shell, and fastening a three-dimensional matrix of structural reinforcement material to the exterior surface of the shell by the fasteners, the matrix having a side facing the exterior surface of the shell that is fastened to be spaced from the exterior surface and define a three-dimensional gap therebetween, the matrix conforming to and covering at least a substantial portion of the exterior surface;

enveloping the matrix with a hardenable cementatious material, the material entering the gap and bonding the matrix to the shell when the material hardens, wherein the shell is substantially hollow and the method comprises molding the shell from a polymer, wherein the concrete structure is formed in the shape of an artificial rock waterfall, and further including installing in the structure a pump and plumbing for the waterfall.

4. An integral casing for constructing a three-dimensional waterproof concrete structure used in an environment in which the structure will be exposed to water, comprising:

a free-standing substantially hollow, so as to form an interior area, three-dimensional and waterproof shell that is sufficiently rigid to support a layer of concrete material, having an exterior surface;

a plurality of fasteners directly attached to the shell; and a matrix of structural reinforcement material having a side facing the exterior surface of the shell, the side being attached by the fasteners to and spaced from the exterior surface to define a three-dimensional gap therebetween, the matrix conforming to and covering at least a substantial portion of the exterior surface, and the matrix is adapted to retain a hardened cementations material covering the integral casing, the cementations material being initially flowable so as to envelop the matrix and enter the gap, thus bonding the matrix to the shell when hardened; and a door way is provided in one side of the shell to enable access into the hollow interior of the shell.

5. An integral casing for constructing a three-dimensional waterproof concrete structure used in an environment in which the structure will be exposed to water, comprising:

a free-standing substantially hollow, so as to form an interior area, three-dimensional and waterproof shell that is sufficiently rigid to support a layer of concrete material, having an exterior surface;

a plurality of fasteners directly attached to the shell; and a matrix of structural reinforcement material having a side facing the exterior surface of the shell, the side being attached by the fasteners to and spaced from the exterior surface to define a three-dimensional gap therebetween, the matrix conforming to and covering at least a substantial portion of the exterior surface, and the matrix is adapted to retain a hardened cementations material covering the integral casing, the cementatious material being initially flowable so as to envelop the matrix and enter the gap, thus bonding the matrix to the shell when hardened;

wherein the integral casing is formed in a general shape of an artificial rock structure and is provided with a pump and plumbing to create a waterfall over the exterior of the structure.

* * * * *